US009528212B2

(12) United States Patent
Lee et al.

(10) Patent No.: US 9,528,212 B2
(45) Date of Patent: Dec. 27, 2016

(54) WASHING MACHINE AND CONTROL METHOD THEREOF

(71) Applicant: SAMSUNG ELECTRONICS CO., LTD., Suwon-si (KR)

(72) Inventors: Sung Mo Lee, Gunpo (KR); Kyo Soon Choi, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 506 days.

(21) Appl. No.: 13/973,214

(22) Filed: Aug. 22, 2013

(65) Prior Publication Data

US 2014/0115792 A1 May 1, 2014

(30) Foreign Application Priority Data

Oct. 31, 2012 (KR) ..... 10-2012-0121824

(51) Int. Cl.
*D06F 37/20* (2006.01)
*D06F 33/02* (2006.01)

(52) U.S. Cl.
CPC ..... *D06F 37/203* (2013.01); *D06F 33/02* (2013.01); *D06F 2204/10* (2013.01); *D06F 2222/00* (2013.01)

(58) Field of Classification Search
CPC .... D06F 37/203; D06F 33/02; D06F 2222/10; D06F 2204/10
See application file for complete search history.

(56) References Cited

U.S. PATENT DOCUMENTS

2003/0020431 A1* 1/2003 Kiuchi ..... D06F 37/304 318/779
2011/0252577 A1* 10/2011 Kim ..... D06F 37/203 8/137

FOREIGN PATENT DOCUMENTS

| | | | |
|---|---|---|---|
| CN | 101676470 | A | 3/2010 |
| CN | 101831778 | A | 9/2010 |
| CN | 102234900 | A | 11/2011 |
| CN | 102301056 | A | 12/2011 |
| EP | 2 175 061 | A1 | 4/2010 |
| EP | 2 381 026 | A2 | 10/2011 |
| JP | 63-127793 | | 5/1988 |

(Continued)

OTHER PUBLICATIONS

Partial European Search Report dated Feb. 3, 2014 in corresponding European Patent Application 13182495.5.

(Continued)

*Primary Examiner* — David Cormier
(74) *Attorney, Agent, or Firm* — Staas & Halsey LLP

(57) ABSTRACT

A washing machine and a control method thereof, capable of reducing noise by performing a zero-current control during the braking of a motor, and checking whether a vibration sensor is installed on a tub in a weight detection state in the beginning of a spin-drying. The zero-current control is performed by driving a current regulator with a command current set to "0 A", so that the current flowing at the motor decreases and thus noise is reduced. In a washing machine having a vibration sensor fixedly attached to a tub, a fixation state of the vibration sensor with respect to the tub is checked in advance by use of measurement data of the vibration sensor at a weight detection stage in the beginning of the spin drying so that the frame touch caused by an erroneous detection of vibration or a failure of vibration detection may be prevented.

10 Claims, 8 Drawing Sheets

(56) References Cited

FOREIGN PATENT DOCUMENTS

| | | |
|---|---|---|
| JP | 5-115674 | 5/1993 |
| JP | 2001-252495 | 9/2001 |
| JP | 2002-336593 | 11/2002 |
| JP | 2004-267334 | 9/2004 |
| JP | 2009-125330 | 6/2009 |
| JP | 2011-142934 | 7/2011 |
| JP | 2012-143513 | 8/2012 |
| JP | 5075719 | 8/2012 |
| KR | 10-0762145 | 10/2007 |

OTHER PUBLICATIONS

European Search Report dated Jun. 2, 2014 in corresponding European Patent Application 13182495.5.
Chinese Office Action dated Sep. 5, 2016 in corresponding Chinese Patent Application No. 201310530467.2.

* cited by examiner

WASHING MACHINE AND CONTROL METHOD THEREOF

CROSS-REFERENCE TO RELATED APPLICATIONS

This application claims the priority benefit of Korean Patent Applications No. 10-2012-0121824, filed on Oct. 31, 2012 in the Korean Intellectual Property Office, the disclosure of which is incorporated herein by reference.

BACKGROUND

1. Field

Embodiments of the present disclosure relate to a washing machine capable of reducing noise by performing a zero-current control during braking of a motor, and a control method thereof.

2. Description of the Related Art

In general, a washing machine (for example, drum washing machine) is an apparatus including a tub to store water (for example, wash water or rinse water), a drum rotatably installed in the tub to accommodate laundry, and a motor to generate a driving force to rotate the drum. When the cylindrical drum rotates, the laundry in the drum is washed through motion of rising and falling along the inner wall of the drum.

Such a washing machine carries out washing in a series of operations of a washing cycle to separate contaminants from laundry with water (specifically, wash water) with detergent dissolved therein, a rinsing cycle to rinse the laundry with water (specifically, rinse water) with no detergent to remove bubbles or residual detergent from the laundry, and a spin-drying cycle to remove moisture contained in the laundry by high-speed rotation of the drum. When the drum is rotated in an imbalanced state with the laundry not distributed uniformly in the drum while washing proceeds in such a series of operations, a biased force is applied to a rotation shaft of the drum so that the washing tub makes eccentric motion, thereby causing vibration of the tub. Such vibration of the tub becomes more severe when the drum rotates at high speed for the spin-drying cycle.

In the convention technology, a vibration sensor to measure the vibration of the tub is fixedly attached to an upper portion of the tub to detect the vibration of the tub generated due to uneven distribution of the laundry. In this manner, the vibration of the tub is detected by the vibration sensor, and if an excessive vibration is generated during a spin-drying cycle, the motor is put to a braking to stop the spin-drying cycle, and water is supplied again to proceed with a laundry disentanglement cycle, and then a spin-dry cycle retry operation is performed to return to the spin-dry cycle.

At this time, in order to brake the motor, a short brake method is used in which a switching device at a lower end of an inverter is turned on, and a switching device at an upper end of the inverter is turned off.

However, the short brake method is configured in which a large amount of current flows at the motor, causing noise during the braking. In particular, a belt-type brushless direct current (BLDC) motor, with noise of a belt added, causes great noise during the brake after a weight detection (sudden acceleration).

When a vibration sensor is fixedly attached to the tub in a normal manner, the vibration of the tub is not detected and the excessive vibration is not detected during the spin-drying cycle, and thus the washing machine may be moved or a frame touch may occur.

SUMMARY

Therefore, it is an aspect of the present disclosure to provide a washing machine capable of reducing noise by performing a zero-current control, and a control method thereof.

It is another aspect of the present disclosure to provided a washing machine capable of checking whether a vibration sensor is installed on a tub at a weight detection stage upon start of a spin-drying, and a control method thereof.

Additional aspects of the disclosure will be set forth in part in the description which follows and, in part, will be apparent from the description, or may be learned by practice of the disclosure.

In accordance with an aspect of the present disclosure, a washing machine includes a tub, a drum, a motor, a vibration sensor and a controller. The drum may be rotatably installed at an inside the tub. The motor may rotate the drum. The vibration sensor, upon entering a spin-dry cycle, may measure vibration of the tub generated by rotation of the motor. The controller may check a fixation state of the vibration sensor by comparing measurement data of the vibration sensor with a reference data.

The vibration sensor may be fixedly installed at an upper portion of the tub.

The controller may detect weight of laundry by instantaneously accelerating the motor, upon entering the spin-drying cycle.

The vibration sensor may measure the vibration of the tub by use of rotary power of the motor generated at the time of the instantaneous acceleration of the motor.

The controller, if the measurement data is smaller than the reference data, may determine the vibration sensor as being in a defective fixation, and brake the motor to stop the spin-drying cycle.

The controller, during the braking of the motor, may perform a zero-current control.

The controller, if the measurement data is equal to or greater than the reference data, may determine the vibration sensor as being in a normal fixation, and proceeds with the spin-drying cycle.

In accordance with another aspect of the present disclosure, a washing machine includes a tub, a drum, a motor, a vibration sensor and a controller. The drum may be rotatably installed at an inside the tub. The motor may rotate the drum. The vibration sensor, during a spin-drying cycle, may measure vibration of the tub generated by rotation of the motor. The controller may compare measurement data of the vibration sensor with a predetermined excessive vibration data, and if the measurement data is greater than the excessive vibration data, may determine the tub as being in an excessive vibration, and brake the motor by performing a zero-current control.

The motor may be a three-phase brushless direct current (BLDC) motor driven by an inverter.

The controller may include a speed command generator to generate a speed command for rotation control of the inverter, a speed regulator to output a command current value according to the speed command of the speed command generator, and a current regulator to output a reference voltage according to the command current value and a phase current of the motor.

The controller, during the braking of the motor, may perform the zero-current control by setting the command current value input into the current regulator as "0 A".

In accordance with another aspect of the present disclosure, a method of controlling a washing machine having a tub, a drum rotatably installed at an inside the tub and a motor to rotate the drum, includes upon entering a spin-drying cycle, measuring vibration of the tub generated by rotation of the motor, by use of a vibration sensor, determining whether the vibration sensor is in a defective fixation by comparing measurement data of the vibration sensor with a reference data, and if the measurement data is smaller than the reference data, determining the vibration sensor as being in a defective fixation and braking the motor to stop the spin-drying cycle, and if the measurement data is equal to or greater than the reference data, determining the vibration sensor as being in a normal fixation, and proceeding with the spin-drying cycle.

The vibration sensor may be fixedly installed at an upper portion of the tub.

In the measuring of the vibration of the tub, upon entering the spin-drying cycle, vibration of the tub generated by rotation of the motor when the motor is instantaneously accelerated to detect weight of laundry may be measured.

The motor may be a three-phase brushless direct current (BLDC) motor driven by an inverter.

In the stopping of the spin-drying cycle, the motor may be braked by performing a zero-current control with a command current value of the inverter set to "0 A".

As is apparent from the above description of the washing machine and the control method thereof, during the braking of the motor, a zero-current control is performed by driving a current regulator with a command current set to "0 A", so that the current flowing at the motor decrease and thus noise is reduced. The application of this concept to a small-middle type washing machine having a belt-type brushless direct current (BLDC) motor allows for more effective noise reduction.

In addition, in a washing machine having a vibration sensor fixedly attached to a tub and a control method thereof, a fixation state of the vibration sensor to the tub is checked in advance by use of measurement data of the vibration sensor at a weight detection stage in the beginning of the spin drying, and in a case in which the vibration is sensor is not normally fixed to the tub during proceeding with the spin-drying cycle, a product liability (PL) accident that may occur due to the movement of the washing machine or the frame touch caused by an erroneous detection of vibration or a failure of vibration detection can be prevented.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
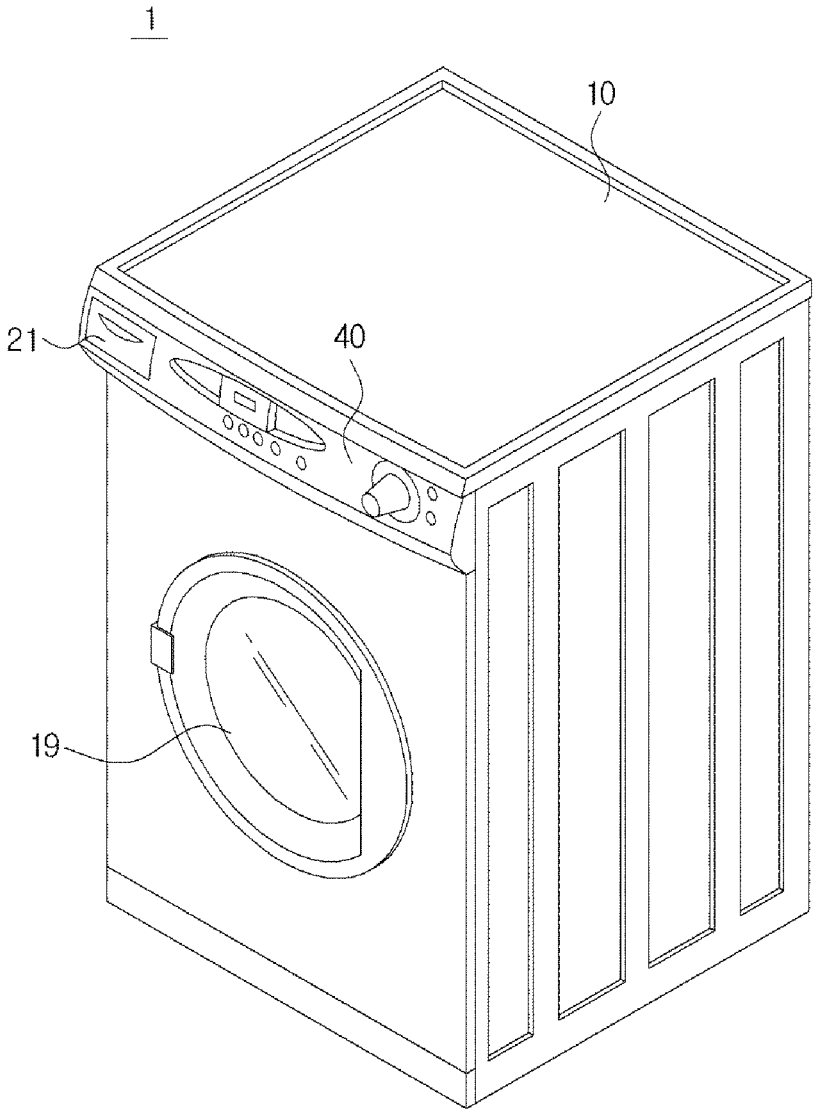
FIG. 1 is a perspective view illustrating an external appearance of a washing machine in accordance with an embodiment of the present disclosure.

Reference will now be made in detail to embodiments of the present disclosure, examples of which are illustrated in the accompanying drawings, wherein like reference numerals refer to like components throughout.

Figure 2:
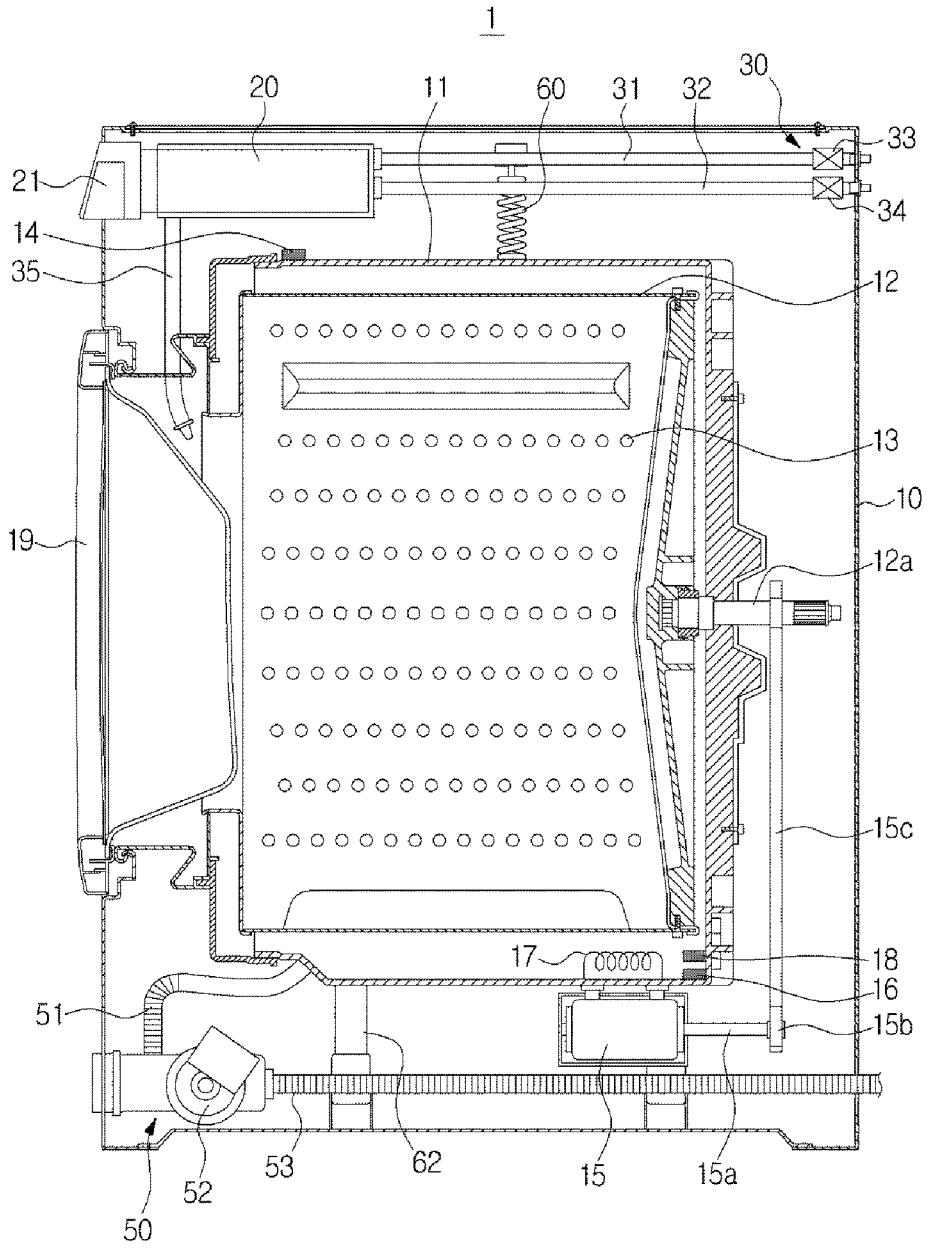
FIG. 2 is a cross-sectional view illustrating the configuration of the washing machine in accordance with an embodiment of the present disclosure.

FIG. 1 is a perspective view illustrating an external appearance of a washing machine in accordance with an embodiment of the present disclosure. FIG. 2 is a cross-sectional view illustrating the configuration of a washing machine in accordance with an embodiment of the present disclosure.

Referring to FIGS. 1 and 2, a washing machine 1 in accordance with an embodiment of the present disclosure includes a body 10 having an approximate box shape and forming an external appearance of the washing machine 1, a tub 11 provided in a drum type while being installed at an inside the body 10 to accommodate water (for example, wash water or rinse water), and a drum 12 rotatably installed at an inside the tub 11 and provided in the shape of a cylinder having a plurality of holes 13.

A vibration sensor 14 is fixedly attached to an outside of an upper portion of the tub 11 to measure the vibration of the tub 11 generated during the operation of the washing machine 1. The vibration sensor 14 may be provided using, for example, a micro electric mechanical system (MEMS) sensor to measure a displacement of the tub 11 moved according to the vibration of the tub 11, a three-axes acceleration sensor to measure vibrations of three axes directions (X-axis direction, Y-axis direction and Z-axis direction), and an angular velocity sensor, referred to as a gyro sensor. A displacement signal measured by the vibration sensor 14 is mainly used to by estimate a balance state of laundry in the drum 12 at the time of acceleration from a low speed to a high speed and to determine whether to operate a high-speed spin drying, to reduce the vibration of the tub 11.

In general, in a washing cycle, an upper and lower direction displacement of the drum 12 occurs due to a mechanical falling of laundry, and such an upper and lower direction displacement of the drum 12 may be measured through the vibration sensor 14.

A motor 15 serving as a driving device is installed at an outside of the lower portion of the tub 11 to rotate a rotating shaft 12*a* connected to the drum 12 to perform a washing cycle, a rinsing cycle and a spin-dying cycle.

The motor 15 is provided using a three-phase brushless direct current (BLDC) motor including a permanent magnet and an electromagnet, and the three-phase BLCD motor, hereinafter, referred to as a motor, is driven by an inverter that supplies three-phase alternating current by switching a voltage according to a pulse width modulation signal. The inverter will be described later with reference to FIG. 4 in detail.

In addition, the driving device to rotate the drum 12 includes a pulley 15*b* and a rotating belt 15*c* that deliver power to the drum 12. The rotating belt 15*c* is installed to be wound around an outer surface of the drum 12 and the pulley 15*b*, which is coupled to a shaft 15*a* of the motor 15.

At an inside of the lower portion of the tub 11, a water level sensor 16 is installed to detect a frequency that varies with the water level so as to detect the amount of water (water level), a washing heater 17 is installed to heat water contained in the tub 11, and a temperature sensor 18 is installed to detect the temperature of water (wash water or rinse water) in the tub 11.

In addition, a door 19 is installed at a front portion of the body 10 such that a laundry is put in or taken out of the inside of the drum 12.

At an upper portion of the tub 11, a detergent supply device 20 to supply detergent, and a water supply device 30 to supply water (wash water or rinse water) are installed.

The detergent supply device 20 has an inside divided into a plurality of spaces, and is installed adjacent to the front portion of the body such that a user may easily input detergent and fabric softener into each space.

In addition, the water supply device 30, in order to supply water (wash water or rinse water) to the inside the tub 11, includes a cold water supply pipe 31 and a hot water supply pipe 32 connecting an outside water supply pipe to the detergent supply device 20, a cold water valve 33 and a hot water valve 34 that are installed amid the cold water supply pipe 31 and the hot water supply pipe 32, respectively, to control water supply, and a connection pipe 35 connecting the detergent supply device 20 to the tub 11. Through such a configuration, the water supplied into the tub 11 passes through the detergent supply device 20, so that detergent in the detergent supply device 20 may be supplied to the tub 11 together with water.

In addition, a control panel 40 on which various buttons and a display are disposed for control of the washing machine 1 is provided above a front of the body 10, and a detergent input portion 21 which is connected to the detergent supply device 20 to put laundry detergent is provided on one side portion of the control panel 40. Although the buttons are used for the control panel 40 as an example, a touch screen or other input method may be provided for the control panel 40.

Various buttons to receive user's commands to select or control the operation of the washing machine 1 and a display unit to display the operation state of the washing machine 1 and the user's manipulation state are disposed on the control panel 40.

Further, the washing machine 1 according to an embodiment of the present disclosure includes a drainage device 50 to draining the water contained in the tub 11. The drainage device 50 includes a first drainage pipe 51 connected to the lower portion of the tub 11 to drain the water of the tub 11 to the outside, a drainage pump 52 installed on the first drainage pipe 51, and a second drainage pipe 53 connected to an exit of the drainage pump 52.

Further, the washing machine 1 according to an embodiment of the present disclosure, in order to reduce vibration generated during the operation of washing machine 1, includes a suspension spring 60 elastically supporting the tub 11 from the upper portion of the tub 11, and a damper 62 to reduce vibration at the lower portion of the tub 11.

The suspension spring 60 and the damper 62 movably support the tub 11 at the upper portion and the lower portion of the tub 11, respectively. That is, as the tub 11 is shaken by the vibration shaking force generated during the rotation of the drum 12, vibration occurs in all directions such as forward, backward, left, right, upward and downward, and such vibration of the tub 11 is reduced by the suspension spring 60 and the damper 62.

Figure 3:
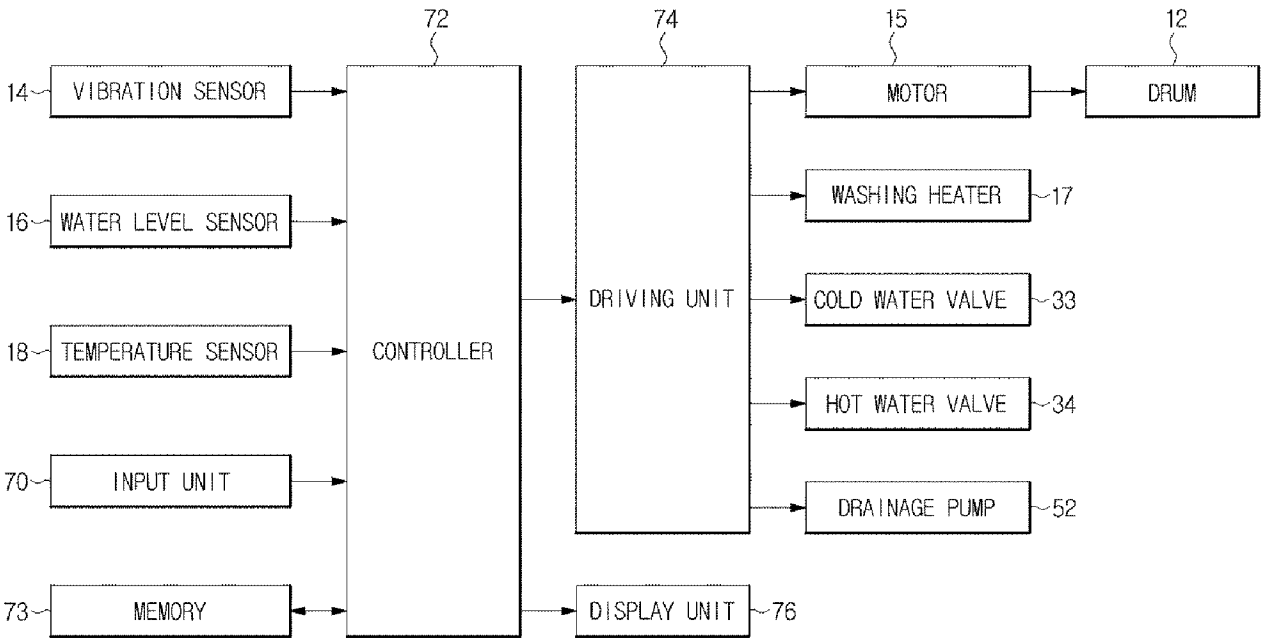
FIG. 3 is a control block diagram of the washing machine in accordance with an embodiment of the present disclosure.

FIG. 3 is a control block diagram of a washing machine in accordance with an embodiment of the present disclosure.

The washing machine 1 in accordance with an embodiment of the present disclosure includes an input unit 70, a controller 72, a memory 73, a driving unit 74, and a display unit 76.

The input unit 70 is for a user to input commands to execute the washing cycle, rinsing cycle and spin-drying cycle of the washing machine 1 through manipulation of the user, and may include keys, buttons, switches and touch pad or the like and include all devices that generate predetermined input data by manipulation of pushing, touching, pressing and rotating.

In addition, the input unit 70 is provided on the control panel 40, and includes a plurality of buttons (for example, power, reservation, wash water temperature, soaking, rinsing, spin-drying, type of detergent, etc) to input user commands related to the operation of the washing machine 1. The plurality of buttons may include a course selection button to select one of a plurality of washing courses (for example, a standard course, a wool course, and a delicate course, for example, the standard course selected by a user depending on the type of laundry) depending on the type of laundry input into the washing machine 1.

The controller 72 is a microcomputer to control the overall operation of the washing machine 1, such as washing, rinsing and spin-drying, according to operation information being input from the input unit 70, and sets a target wash water level, a target rinse water level, a target Revolutions Per Minute (RPM) and a motor operating rate (for example, motor on-off time), a washing time and a rinsing time according to the weight or load of laundry in the selected washing course.

In addition, the controller 72, in the beginning of the spin-drying cycle, checks a fixation state of the vibration sensor 14 with respect to the tub 11 in a weight detection stage of instantaneously accelerating the motor 15 to detect the weight or load of the laundry. That is, it is checked whether the vibration sensor 14 is fixedly attached to the tub 11 in a normal manner, by use of rotating power of the motor 15 generated during the instantaneous acceleration of the motor 15 in the weight detection stage in the beginning of the spin-drying cycle. To this end, the controller 72 receives a vibration displacement data of the tub 11 being measured through the vibration sensor 14, which is fixed at the upper portion of the tub 11, at the instantaneous acceleration of the motor 15.

The controller 72 compares the measurement data of the vibration sensor 14 with a predetermined reference data (for example, displacement data used to determine whether the vibration sensor is normally fixed to the tub at the instantaneous acceleration of the motor). As a result of comparison, if the measurement data of the vibration sensor 14 is smaller than the reference data, the fixation state of the vibration sensor 14 is determined as being defected, and the spin-drying cycle may end. In this case, the controller 72 notifies the user of the defective fixation state of the vibration sensor 14 through the display unit 76.

As a result of comparison, if the measurement data of the vibration sensor 14 is equal to or larger than the reference data, the fixation state of the vibration sensor 14 is determined as being normal, and the spin-drying cycle is normally carried out. Through this method, the controller 72 checks the fixation state of the vibration sensor 14 with respect to the tub 11 in advance in the beginning of the spin-drying cycle, thereby preventing the washing machine from being moved and preventing a frame touch.

In addition, in order to determine the fixation state of the vibration sensor 14 in more precise manner, the controller 72 may check whether the vibration sensor 14 is normally fixed to the tub 11 by calculating the average of the measurement data or measurement counts at the weight detection stage in the beginning of the spin-drying cycle.

In addition, the controller 72 measures the vibration of the tub 11 generated by the rotating power of the motor 15 in the spin-drying cycle, and if an excessive vibration occurs, stops the spin-drying cycle by braking the motor 15, and supplies water again to proceed with a laundry disentanglement cycle, and then performs a spin-dry retry operation to return to the spin-drying cycle.

The controller 72, upon the excessive vibration of the tub 11, performs a zero-current control to brake the motor 14. The zero-current control represents controlling an inverter while setting a command current value to 0 A (Ampere) at the braking of the motor 15. The zero-current control will be described later with reference to FIG. 5 in detail.

A section at which the zero-current control is performed to brake the motor 15 is applied to a case when the spin-drying cycle is stopped after being normally carried out, or case when the spin-drying cycles encounters an error, in addition to the case when the excessive vibration of the tub 11 occurs.

The memory 73 includes setting information such as control data to control the operations of the washing machine 1, reference data used in control of the operations of the washing machine 1, operation data generated while the washing machine 1 is performing a predetermined operation, and setting data input by the input unit 70 for the washing machine 1 to perform a predetermined operation, use information including the number of times that the washing machine 1 performs a specific operation and model information of the washing machine 1, and failure information including the cause of malfunction or the location of malfunction in case of malfunction of the washing machine 1.

The driving unit 74 drives the motor 15, the washing heater 17, the cold water valve 33, the hot water valve 34 and the drainage pump 52 that are related to the operation of the washing machine 1 according to a driving control signal.

The display unit 76 is provided on the control panel 40, and displays the operation state and the user manipulation state of the washing machine 1 according to a display control signal of the controller 72.

Figure 4:
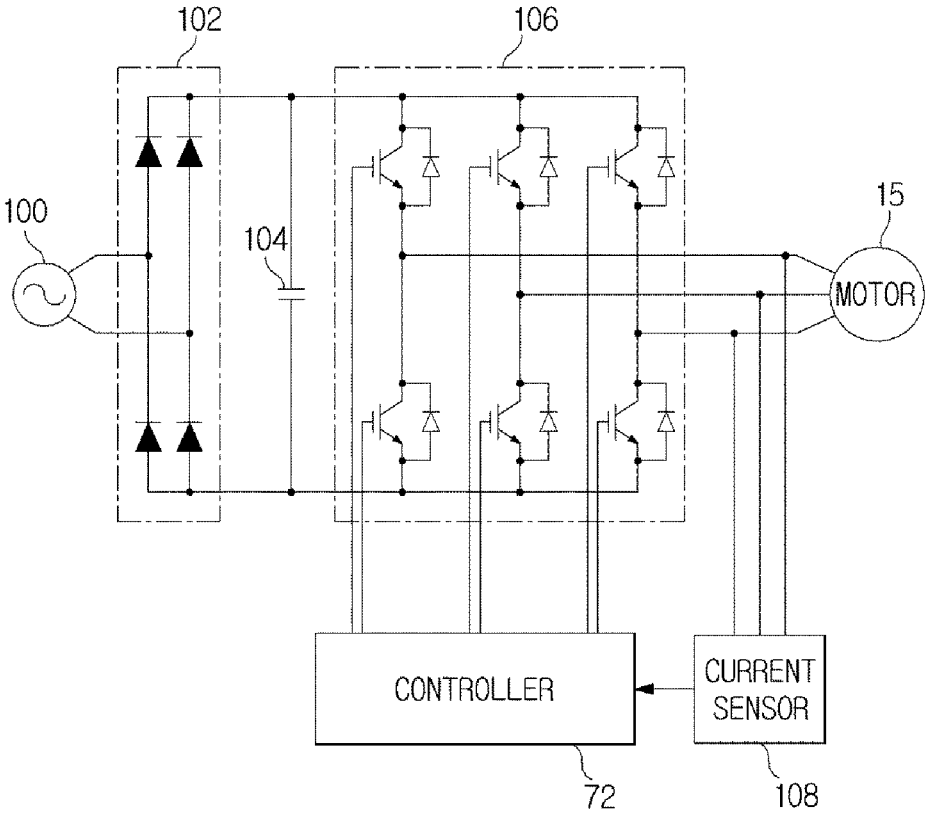
FIG. 4 is a circuit diagram of an inverter for driving a motor of the washing machine in accordance with an embodiment of the present disclosure.

FIG. 4 is a circuit diagram of an inverter to drive a motor of the washing machine in accordance with an embodiment of the present disclosure Referring to FIG. 4, an inverter circuit to drive the motor 15 in accordance with an embodiment of the present disclosure includes a rectifier 102 to rectify a commercial power 100 being supplied in the form of alternating current of 220V-60 Hz, a smoother-electrolytic condenser 104 connected to the rectifier 102 to smooth a rectified direct current voltage and accumulate electrical energy, an inverter 106 connected to the smoother-electrolytic condenser 104 to convert the direct current voltage being output from the smoother-electrolytic condenser 104 into three-phase alternating current (U, V and W) in the form of a pulse having a random variable frequency by way of pulse-width modulation to drive the motor 15, a current sensor 108 to detect a phase current of the motor 15, and the controller 72 to control the inverter 106 by outputting a Pulse Width Modulation (PWM) signal pattern being provided to the inverter 106.

The inverter 106 is an intelligent power module (IPM) configured to convert a direct current voltage into three-phase alternating current while having six switching devices (insulated-gate bipolar transistors: IGBT) connected to six diodes (fast recovery diodes: FRD) in the form of a three-phase full bridge, and supply the three-phase alternating current to the motor 15.

The current sensor 108 is configured to detect the magnitude of load current (phase current) being supplied to the motor 15, and input the detected magnitude of load current into an A/D converter of the controller 72. The current sensor 108 may be implemented in a desired manner generally known in the art.

For example, the current sensor 108 may be implemented in a manner to directly detect three-phase current by using a current transformer (CT) or a series shunt resistant for each of the three phases, or in a manner to detect two phase current by use of two current transformers or two series direct shut resistors and then estimate the remaining current based on the detected current values of the two phases.

The controller 72 is a microcomputer to controls the on/off of the six switching devices of the inverter 106, and generate three-phase alternating current of a random voltage and a random frequency, and the driving of the motor 15 through the PWM control is generally known in the art.

In addition, the controller 72, for rotation control of the inverter 106 outputs a pattern of PWM signals being supplied to the inverter 106, by detecting a direct current voltage Vdc linked to the smoother-electrolytic condenser 104 and detecting phase current of the motor 15 through the current sensor 108.

Figure 5:
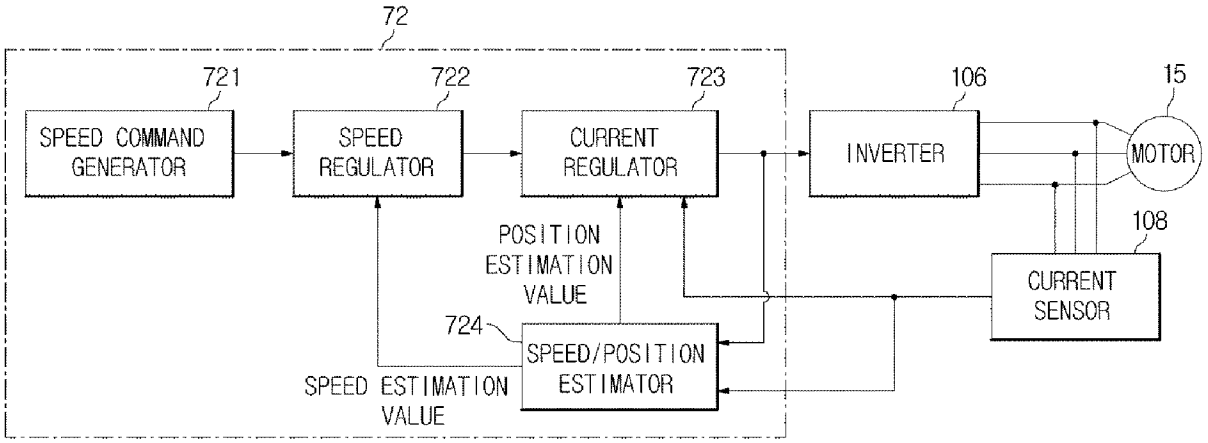
FIG. 5 is a control block diagram of a zero-current control of an inverter in accordance with an embodiment of the present disclosure.

FIG. 5 is a control block diagram of a zero-current control of an inverter in accordance with an embodiment of the present disclosure.

Referring to FIG. 5, the controller 72 for the zero-current control includes a speed command generator 721 to generate a speed command for rotation control of the inverter 106, a speed regulator 722 to output a command current value according to the speed command of the speed command generator 721 and a speed estimation value, and a current regulator 723 to output a reference voltage to drive the motor 15, according to the command current value of the speed regulator 722 and a phase current (for example, measurement current) of the motor 15, and a speed/position estimator 724 to estimate speed and position of the motor 15 according the phase current (for example, measurement current) of the motor 15 and the reference voltage being output from the current regulator 723 to deliver a speed estimation and a position estimation value to the speed regulator 722 the current regulator 723, respectively.

The controller 72 brakes the motor 15 when the tub 11 comes upon an excessive vibration, a spin-drying cycle is stopped after being normally carried out or a spin-drying cycle encounters an error. In this case, the controller 72 performs the zero-current control by setting the command current value, being input to the current regulator 723, to "0 A".

Hereinafter, the function and effect of a control method of a washing machine in accordance with an embodiment of the present disclosure will be described.

Figure 6:
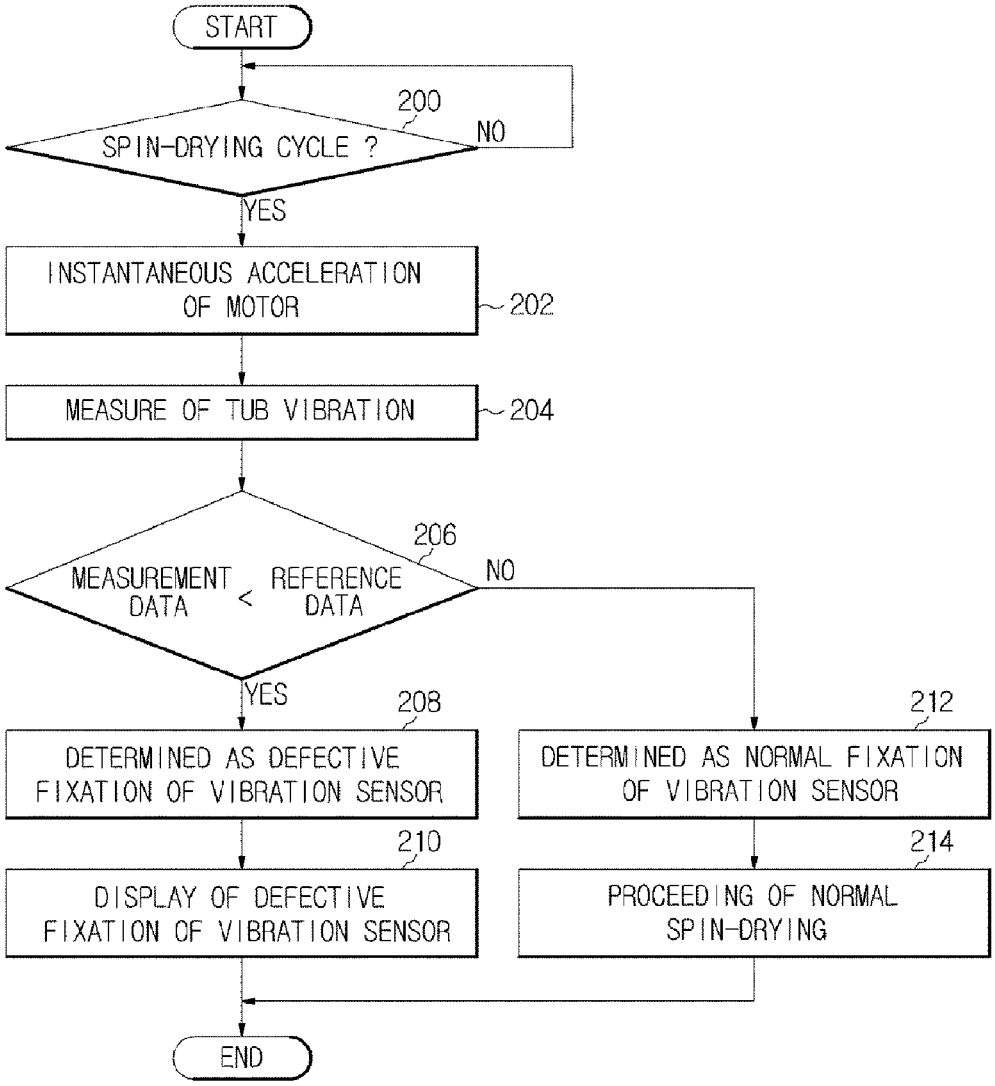
FIG. 6 is a flow chart of a control method for determining a fixation state of a vibration sensor of the washing machine in accordance with an embodiment of the present disclosure.

FIG. 6 is a flow chart of a control method to determine a fixation state of the vibration sensor of the washing machine in accordance with an embodiment of the present disclosure.

Referring to FIG. 6, as a user puts laundry into the drum 12, and selects operation information, such as the washing course or additive rinsing, according to the type of laundry, by manipulating the buttons of the input unit 70 disposed on the control panel 40, the operation information selected by the user is input to the controller 72 through the input unit 70.

The controller 72 performs a series of sequential operations of a washing cycle, a ringing cycle and a spin-drying cycle according to the operation information input from the input unit 70.

For control of the spin-drying in accordance with an embodiment of the present disclosure, the controller 72 determines a spin-drying cycle (200) is performed, and if determined as a spin-drying cycle is performed, operates the drainage pump 52 through the driving unit 74 so that the water in the tub 11 is drained to the outside by passing through the first drainage pipe 51 and the second drainage pipe 53.

As the drainage starts, the controller 72 detects the weight of laundry being put into the drum 12, in the beginning of the spin-drying cycle to proceed with the spin-drying cycle. For a method of detecting the weight of laundry, it is possible to employ any one method of detecting the weight by use of a time taken to reach a predetermined speed or a predetermined revolution per minute (RPM) through instantaneous acceleration of the motor 15, and detecting the weight of laundry by applying a torque to the motor 15 for a predetermined time to directly or indirectly measure the inertial quantity of the drum 12 and then by using the second low of motion (torque-inertial moment×angular velocity), as disclosed in Japanese Patent Publication Nos. 2002-336593, 2004-267334, and H07-90077.

As described above, in order to detect the weight (load) of the laundry, the controller 72 instantaneously accelerates the motor 15 through the driving unit 74 at a predetermined RPM (about 90 RPM) or above (202).

Accordingly, a vibration of the tub 11 occurs due to the rotating power of the motor 15 generated at the instantaneous acceleration, and the vibration sensor 14 fixedly attached to the upper portion of the tub 11 measures the vibration of the tub 11 generated due to the rotating power of the motor 15 at the instantaneous acceleration of the motor 15 and inputs the measured vibration to the controller (204).

Accordingly, the controller 72 compares the input measurement data of the vibration sensor 14 with a predetermined reference data (for example, a displacement data used to determine whether the vibration sensor is normally fixed to the tub at the moment of instantaneous acceleration of the motor) (206).

As a result of comparison of operation 206, if the measurement data of the vibration sensor 14 is smaller than the reference data, the controller 72 determines that the fixation state of the vibration sensor 14 is defective (208), and ends the spin-drying cycle while displaying the defective fixation state of the vibration sensor 14 through the display unit 76.

Further, as a result of comparison of operation 206, if the measurement data of the vibration sensor 14 is equal to or larger than the reference data, the controller 72 determines that the fixation state of the vibration sensor 14 is normal (212), and proceeds with the spin-drying cycle in a normal manner (214).

As described above, at the weight detection stage in the beginning of the spin-drying cycle, the fixation state of the vibration sensor 14 with respect to the tub 11 is checked in advance by use of the measurement data of the vibration sensor 14 in the washing machine having the vibration sensor 14 attached to the tub 11. Accordingly, when the vibration sensor 14 is not normally fixed to the tub 11 in proceeding with the spin-drying cycle, a product liability (PL) accident due to the movement of the washing machine or a frame touch that may be caused by an erroneous detection of vibration or failure of vibration detection may be prevented.

Figure 7:
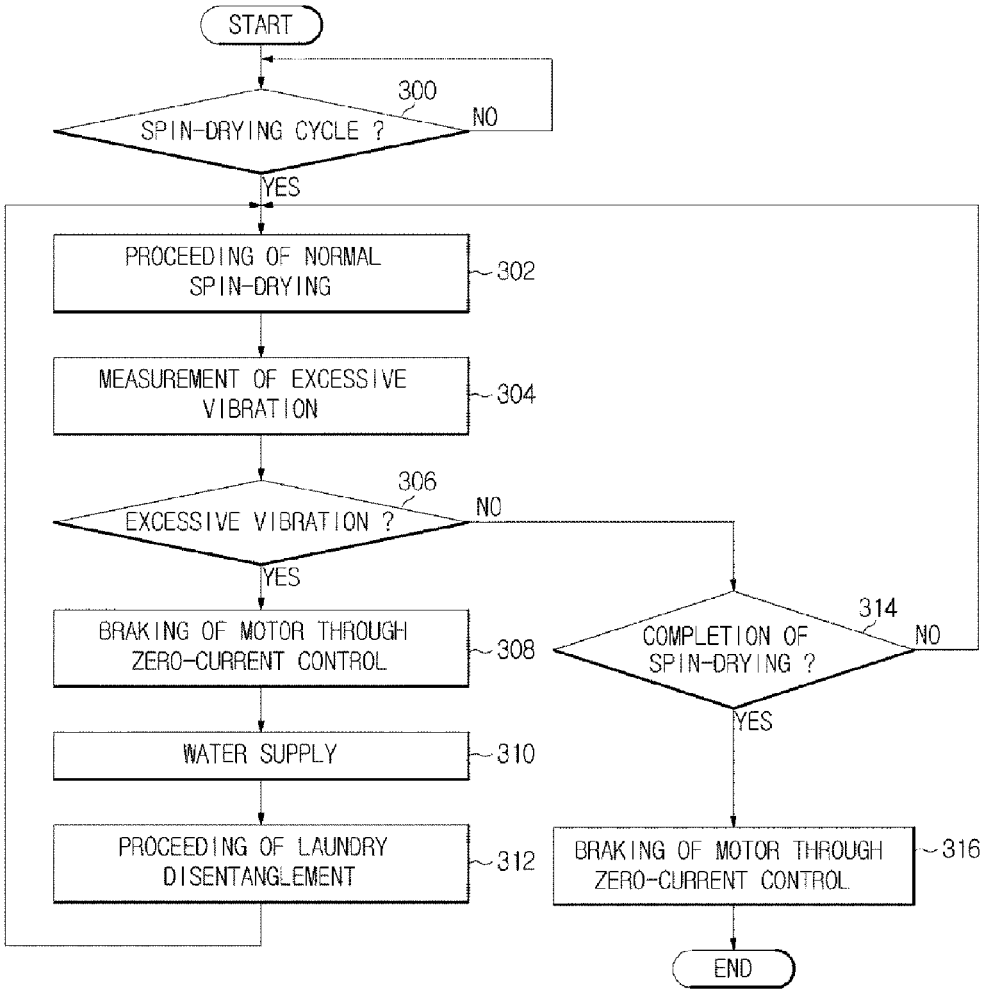
FIG. 7 is a flow chart of a control method for stopping a motor of the washing machine in accordance with an embodiment of the present disclosure.

FIG. 7 is a flow chart of a control method to stop a motor of the washing machine in accordance with an embodiment of the present disclosure.

Referring to FIG. 7, a user puts laundry into the drum 12, and selects operation information, such as a washing course or an additive rinsing, by manipulating the buttons of the input unit 70 disposed on the control panel 40, and the operation information selected by the user is input to the controller 72 through the input unit 70.

Accordingly, the controller 72 performs a series of sequential operations of a washing cycle, a rinsing cycle and a spin-drying cycle according to the operation information input from the input unit 70.

For the control of the spin-drying in accordance with an embodiment of the present disclosure, the controller 72 determines a spin drying cycle (300), and if determined as a spin-drying cycle, proceeds with the spin-drying cycle at a predetermined final spin-drying RPM (about 700 RPM to about 1000 RPM) (302).

If the drum 12 is rotated in an imbalance state having the laundry unevenly distributed toward one side in the drum 12, a biased force is applied to a rotating shaft of the drum 12 and the drum 12 makes an eccentric motion, thereby causing vibration of the tub 11. Such a vibration of the tub 11 becomes more severe when the drum 12 rotates at a high speed for the spin-drying cycle.

Accordingly, the vibration sensor 14 fixedly attached to the upper portion of the tub 11 measures the vibration of the tub 11 generated due to high speed rotation of the drum 12 in the spin-drying cycle, and inputs the measured vibration to the controller 72 (304).

Accordingly, the controller 72 compares the input measurement data of the vibration sensor 14 with a predetermined excessive vibration data (for example, displacement data used to determine an excessive vibration of the tub in the spin-drying cycle), and determines whether an excessive vibration occurs (306).

If determined from operation 306 that an excessive vibration occurs, the controller 72 brakes the motor 15 through a zero-current control (308).

A method of performing the zero-current control at the braking of the motor 15 will be described with reference to FIGS. 4 and 5 in detail.

Referring to FIGS. 4 and 5, a commercial power 100 is input, and the power in the form of an alternating current of 220V (Volt)-60 Hz (Hertz) is rectified by the rectifier 102, and the rectified power is smoothed by the smoother-electrolytic condenser 104 connected to the rectifier 102 to be converted into a direct current for output.

The direct current voltage being output from the smoother electrolytic condenser 104 is converted into three-phase alternating current having random variable frequencies by way of a pulse-width modulation (PWM) at the inverter 106, and then is supplied to the motor 15 so that the motor 15 is driven. The driving of the motor 15 through the PWM control is generally known in the art, and thus detailed description thereof will be omitted.

In order to perform the zero-current control in accordance with the present disclosure, the controller 72, at the braking of the motor 15, sets the command current value input into the current regulator 723 as "0 A".

By setting the command current value as "0 A", the current regulator 723 outputs a reference voltage to drive the motor 15 according to the command current value of "0 A" and the phase current (measurement current) of the motor 15 detected by the current sensor.

With respect to outputting the reference voltage from the current regulator 723, the current being supplied to the motor 15 decreases due to the command current value of "0 A", thereby increasing the time to brake the motor 15 when compared to the braking time of the short brake method, while reducing the noise. Such a noise reduction is more effective at a belt type small-middle sized washing machine.

In this manner, the RPM is lowered by braking the motor 15 through the zero-current control, and water is supplied through the cold water valve 33 or the hot water valve 34 (310).

Thereafter, the controller 72 drives the motor 15 to perform a laundry disentanglement of shaking and releasing the entanglement of laundry by alternately rotating the drum 12 (312), and returns to operation 302 to proceed with the spin-drying cycle again.

Meanwhile, if determined from operation 306 that an excessive vibration does not occur, the controller 72 determines whether the spin-drying cycle is completed to proceed with a normal spin-drying cycle (314).

If determined from operation 314 that the spin-drying cycle is not complete, the controller 72 returns to operation 302 to proceed with the spin-drying cycle.

If determined from operation 314 that the spin-drying cycle is complete, the controller 72 brakes the motor 15 through the zero-current control (316), and ends the spin-drying cycle.

Figure 8:
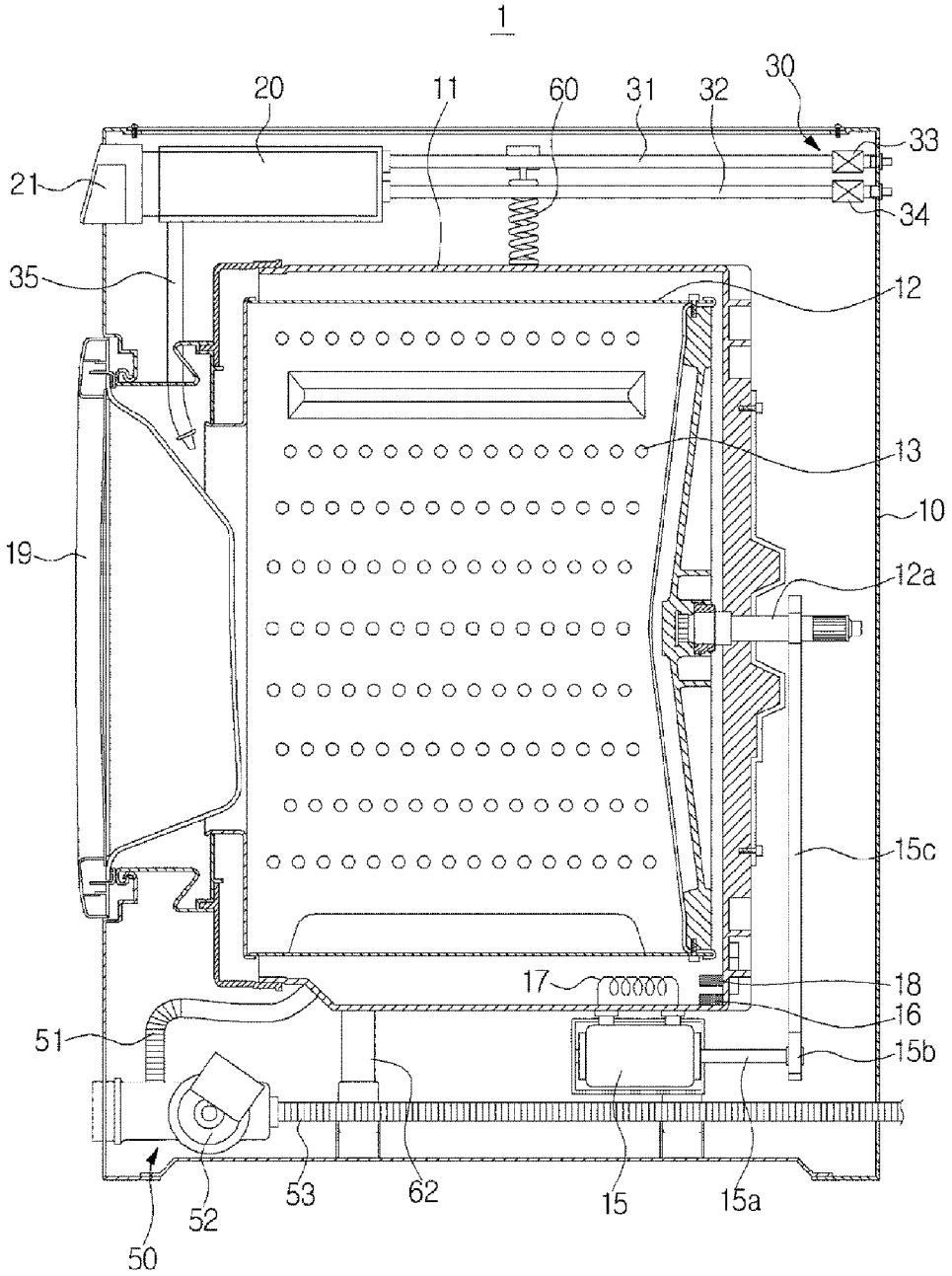
FIG. 8 is a cross-sectional view illustrating the configuration of a washing machine in accordance with another embodiment of the present disclosure.

Although the above description in accordance with an embodiment of the present disclosure has been made in relation to a method of braking the motor 15 in the washing machine having the vibration sensor 14 attached thereto, the same effect and function of the present disclosure may be implemented when braking the motor 15 in a washing machine not having the vibration sensor 14 attached thereto as illustrated on FIG. 8.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a tub;

a drum rotatably installed at an inside of the tub;

a motor to rotate the drum;

a vibration sensor, upon entering a spin-drying cycle, to measure vibration of the tub generated by rotation of the drum by the motor; and a controller configured to determine a fixation state of the vibration sensor by comparing the measured vibration data of the vibration sensor with reference data, wherein the controller, if the measured vibration data is smaller than the reference data, determines the vibration sensor is in a defective fixation state, and brakes the motor to stop the spin-drying cycle, and wherein the controller, if the measured vibration data is equal to or greater than the reference data, determines the vibration sensor is in a normal fixation, and proceeds with the spin-drying cycle.

2. The washing machine of claim 1, wherein the vibration sensor is fixedly installed at an upper portion of the tub.

3. The washing machine of claim 1, wherein the controller detects weight of laundry by instantaneously accelerating the motor, upon entering the spin-drying cycle.

4. The washing machine of claim 3, wherein the vibration sensor measures the vibration of the tub by use of rotary power of the motor generated at the time of the instantaneous acceleration of the motor.

5. The washing machine of claim 1, further comprising an inverter to drive the motor, wherein the controller comprises a speed command generator to generate a speed command for rotation control of the inverter, a speed regulator to output a command current value according to the speed command of the speed command generator, and a current regulator to output a reference voltage according to the command current value and a phase current of the motor, wherein the controller, during the braking of the motor, performs a zero-current control by setting the command current value input into the current regulator as 0 A (Ampere).

6. A method of controlling a washing machine having a tub, a drum rotatably installed at an inside the tub and a motor to rotate the drum, the method comprising:

upon entering a spin-drying cycle, measuring vibration of the tub generated by rotation of the motor, by use of a vibration sensor;

determining whether the vibration sensor is in a defective fixation by comparing measurement data of the vibration sensor with a reference data;

if the measurement data is smaller than the reference data, determining the vibration sensor as being in the defective fixation and braking the motor to stop the spin-drying cycle; and if the measurement data is equal to or greater than the reference data, determining the vibration sensor as being in a normal fixation, and proceeding with the spin-drying cycle.

7. The method of claim 6, wherein the vibration sensor is fixedly installed at an upper portion of the tub.

8. The method of claim 6, wherein in the measuring of the vibration of the tub, upon entering the spin-drying cycle, the vibration of the tub generated by rotation of the motor when the motor is instantaneously accelerated to detect weight of laundry is measured.

9. The method of claim 6, wherein the motor is a three-phase brushless direct current (BLDC) motor driven by an inverter.

10. The method of claim 9, wherein in the stopping of the spin-drying cycle, the motor is braked by performing a zero-current control with a command current value of the inverter set to 0 A.

* * * * *